US007059737B2

(12) United States Patent
Oswald

(10) Patent No.: US 7,059,737 B2
(45) Date of Patent: Jun. 13, 2006

(54) FLOATING LIGHT

(76) Inventor: Willi Wolfgang Oswald, Lettenbündte 10 + 12, Schwörstadt (DE) 79739

( * ) Notice: Subject to any disclaimer, the term of this patent is extended or adjusted under 35 U.S.C. 154(b) by 75 days.

(21) Appl. No.: 10/432,794

(22) PCT Filed: Sep. 6, 2001

(86) PCT No.: PCT/EP01/10265

§ 371 (c)(1),
(2), (4) Date: May 22, 2003

(87) PCT Pub. No.: WO02/42684

PCT Pub. Date: May 30, 2002

(65) Prior Publication Data

US 2004/0052082 A1 Mar. 18, 2004

(30) Foreign Application Priority Data

Nov. 23, 2000 (DE) ..... 100 58 268

(51) Int. Cl.
*F21V 29/00* (2006.01)

(52) U.S. Cl. ..... 362/101; 362/477

(58) Field of Classification Search ..... 362/101, 362/477; 43/17.5, 17.6; 441/13, 20, 21, 441/23

See application file for complete search history.

(56) References Cited

U.S. PATENT DOCUMENTS 2,099,506 A 11/1937 Winckler
2,539,403 A * 1/1951 Crim et al. ..... 441/17
3,757,104 A * 9/1973 Cooper ..... 362/477
4,809,458 A 3/1989 Tanikuro et al.
5,176,552 A 1/1993 Kuboyama et al.
5,235,774 A * 8/1993 Burghoff ..... 43/17.1
5,362,267 A 11/1994 Forrest
5,416,676 A 5/1995 Carpenter
6,220,718 B1 * 4/2001 Burgess ..... 362/101
6,224,241 B1 5/2001 Oswald

FOREIGN PATENT DOCUMENTS

DE 78 15 805 U1 9/1978
DE 200 19 964 U1 3/2001
JP 58053596 A 3/1983

* cited by examiner

*Primary Examiner*—Sandra O'Shea
*Assistant Examiner*—Anabel Ton
(74) *Attorney, Agent, or Firm*—Volpe and Koenig, P.C.

(57) ABSTRACT

A floating light (1), having a base (2) which accommodates a light source or luminescing means; and a screen (3) which is connected thereto and which surrounds the light source. The screen has an inlet opening (4) for connection with the base (2) and an otherwise closed, preferably substantially spherical surface. The light has a seal in the contact area (6) between the screen and the base (2), preferably a sealing element or sealing ring (5), so that in the operational position, the sealed contact area (6) can be located beneath the surface (7) of a liquid in which the floating light is to float. In the operational position, at least one fixing element which extends below the surface (7) of the liquid and which can be or is anchored is located on the screen (3), enabling the floating light to be fixed in the liquid in a stationary position or with a small degree of mobility and ensuring that the contact area (6) is not strained when forces are exerted on the fixing element (8), as would be the case if the fixing element was attached to the base (2).

15 Claims, 3 Drawing Sheets

FLOATING LIGHT

BACKGROUND

The invention relates to a floating light with a light base receiving at least one light source or lighting means, and with a light screen which can be connected thereto and surrounds the light source, with an aperture for connecting to the light base and in addition having a closed, in particular substantially spherical surface, a seal being provided in the contact area between the light screen and light base, and the sealed contact area between the light screen and the light base being located in the use position below the surface of the liquid which the receives the floating light, whereby the floating light is connected with at least fastening element that extends under the surface of the liquid and is there anchored or anchorable.

From U.S. Pat. No. 5,176,552, a floating light in accordance with the above-mentioned type is known, that includes a light source carried by a light base as well as a light screen connected therewith that surrounds the light source, and includes an opening for connection with the light base, whereby a fastening element is connected to the light base that is anchored under the surface of the liquid on which the floating light floats. Because the connection area between the light base and the light screen is under the surface of the water in the use position at least part of the time, a seal or a sealing element is provided between the light base and the light screen in the connection area.

In the use position for floating in the water, light and in particular spherical shaped light screens provide a strong buoyancy force, while against this the at least one connecting element anchored light base can not float. The opposing forces of the light base on the one side and the light base on the other side load the connection area of the light piece provided seal so that over time the seal can fail.

A similar floating light is known from EP 0 907 865 B1, particularly from FIG. 3. With such a floating light, a stretch of water can be illuminated, and the floating light can be provided floating at practically any optional position along the stretch of water.

The light base there has the electrical cable and can be anchored therewith.

Trials have already been performed of anchoring the light base with a retaining device.

In these cases it has however been found that with wind, waves, or other loads between the light base and the light screen a force can arise acting in the separating direction of these two portions. The anchoring tends to hold the base, while buoyancy or wind forces act on the light screen against this anchoring force. The danger thereby arises that in the course of time seal failures arise at the sealed contact area and liquid or water enters the floating light. This can above all occur when the seal, inserted as a seal or sealing element and kept constantly under pressure, gradually fatigues and its material loses elasticity, or completely moves aside or creeps away under the compressing force.

SUMMARY

The object therefore exists of providing a floating light of the kind mentioned at the beginning, in which, in spite of the anchoring, no or at most small forces are exerted on the contact area between the light base and the light screen.

To attain this object, at least one fastening element is arranged on the light screen of the floating light.

Because the fastening element in accordance with the floating light of the invention is arranged on the light screen and not on the light base, the retaining forces are exerted on the light screen and not on the light base, so that the forces applied to the light screen can be at least predominantly received by the fastening element, and thus do not load the contact area between the light screen and light base and thus not the sealed contact area. By this solution, it is even possible to pull the floating light a little under water against its buoyancy, since the buoyancy forces then acting on the light screen do not load the connection area with the light base, but directly load the fastening element(s). Or else, with a fastening element which is at first loosely arranged, and allows the floating light a certain freedom of movement, forces produced, for example, by wind or waves are taken up by the fastening element.

The light screen can have at least one fastening place for fixing one or more fastening elements acting as tension elements, and an anchor, a weight, a hook, an eyelet, or the like can be arranged at the end of the fastening element(s) located under water. Thus the fastening element(s) is/are invisible in the use position, since they are mostly or even completely arranged under water.

It is particularly favorable when plural, for example three or four, fastening places for fastening to tension elements are arranged on the periphery of the light screen, in particular at the same height and/or uniformly distributed on the periphery, and when a fastening element engages in the use position on at least one of these fastening places or on a plurality of fastening places. Thus the user has several possibilities as to how to position and fix the floating light on a water surface, for example on a dike or the like, but can also allow a certain freedom of movement.

In this way it is possible for a weight to be provided, engaging the fastening element(s) under water, with its weight in particular greater than the buoyancy of the floating light in the liquid receiving it. Thus the floating light is fixed by the fastening element(s) with the aid of such a weight, but can however be changed in position by changing the location of the weight. The fastening place(s) for the fastening element(s) holding the light screen can be arranged in the region about spherical light screen, which in the use position is situated beneath the greatest horizontal diameter and in particular under water. The fastening place(s) is/are located in a region of the spherical light screen which has a decreasing dimension relative to the greatest horizontal extent, so that the fastening elements, as a rule formed as tension elements, can be directly tensioned or laid from the fastening place to the anchoring place, without having to run over a portion of the surface of the light screen. With an arrangement in the region situated under water in the use position, not only these fastening elements, but also the fastening places, are practically invisible.

The fastening place(s) on the surface of the light screen can be formed as a recess, notch, eyelet, projection or hook, separated with respect to the interior of the light screen by a wall. Thus in this region no access of water to the interior of the light screen is possible, most preferably through integral manufacture, so that no separate sealing means is required in the region of the fastening places.

The fastening place(s) can be arranged on the surface of the light screen in a hollow of this surface and preferably completely sunk within this hollow. Thereby at the same time the fastening of the fastening element at this fastening place is well protected and also practically invisible even in relatively clear water.

The spherical surface of the light screen can merge below its greatest horizontal diameter region into a frustroconical surface tapering downward in the use position, with the entry aperture for the sealed light base arranged on its lower edge. Thus in region of the floating light which is substantially under water in the use position, a conical shape results which can contribute to the stabilization of the floating light in its floating position.

The fastening places for anchoring the floating light may be arranged in the region of the light screen which has the frustroconical surface. The fastening places can thus be arranged relatively close to the contact area between the light base and the light screen, so that with tensile forces on the fastening places, these occur at the smallest or shortest possible lever arms.

The portion of the light base which projects outward and, in the use position, downward with respect to the aperture in the light screen can have a frustroconical or conical surface, and this can substantially continue or augment the frustroconical region of the light screen to a longer conical frustrum or cone. Thus a relatively regular pointed or conically tapering shape results on the normally deepest place of the floating light and makes possible a correspondingly stable floating position, especially as the base with the light source or the lighting means places the center of gravity of the whole arrangement relatively low and automatically tends to have the light base coming to lie as perpendicularly as possible under the middle of the light screen.

The fastening element formed as a tension element can be a rope, cord, cable or chain, or else if necessary a bar or a rod.

Above all with a combination of one or more of the features described hereinabove, a floating light results which can be anchored under water without undesired forces being exerted by this anchoring on the sealing region between the light base and the light screen. Thus even arbitrarily great anchoring forces can be used, according to whether the floating light is to be held as firmly as possible at one place, or whether a certain freedom of movement is desired, in which the floating light can move on the surface in a limited region. That the retaining forces on the floating light which arise from the fastening element(s) exert a separating force on the sealed contact area between the light base and the light screen is thereby avoided.

BRIEF DESCRIPTION OF THE DRAWINGS

An exemplary embodiment of the invention is described in detail hereinafter using the accompanying drawing. In the partially schematized diagrams.

DETAILED DESCRIPTION OF THE PREFERRED EMBODIMENT

A floating light denoted as a whole by 1 has a light source or a lighting means which is not shown in the diagram for better visibility. This light source or this lighting means can be fixed to a light base 2 in the manner shown and described in EP 0 907 865 B1.

This light base 2 can be connected with a light screen 3 which in the use position encloses the light source, and which is shown in FIGS. 1–4 and likewise generally corresponds to the construction according to EP 0 907 865 B1.

Figure 4:
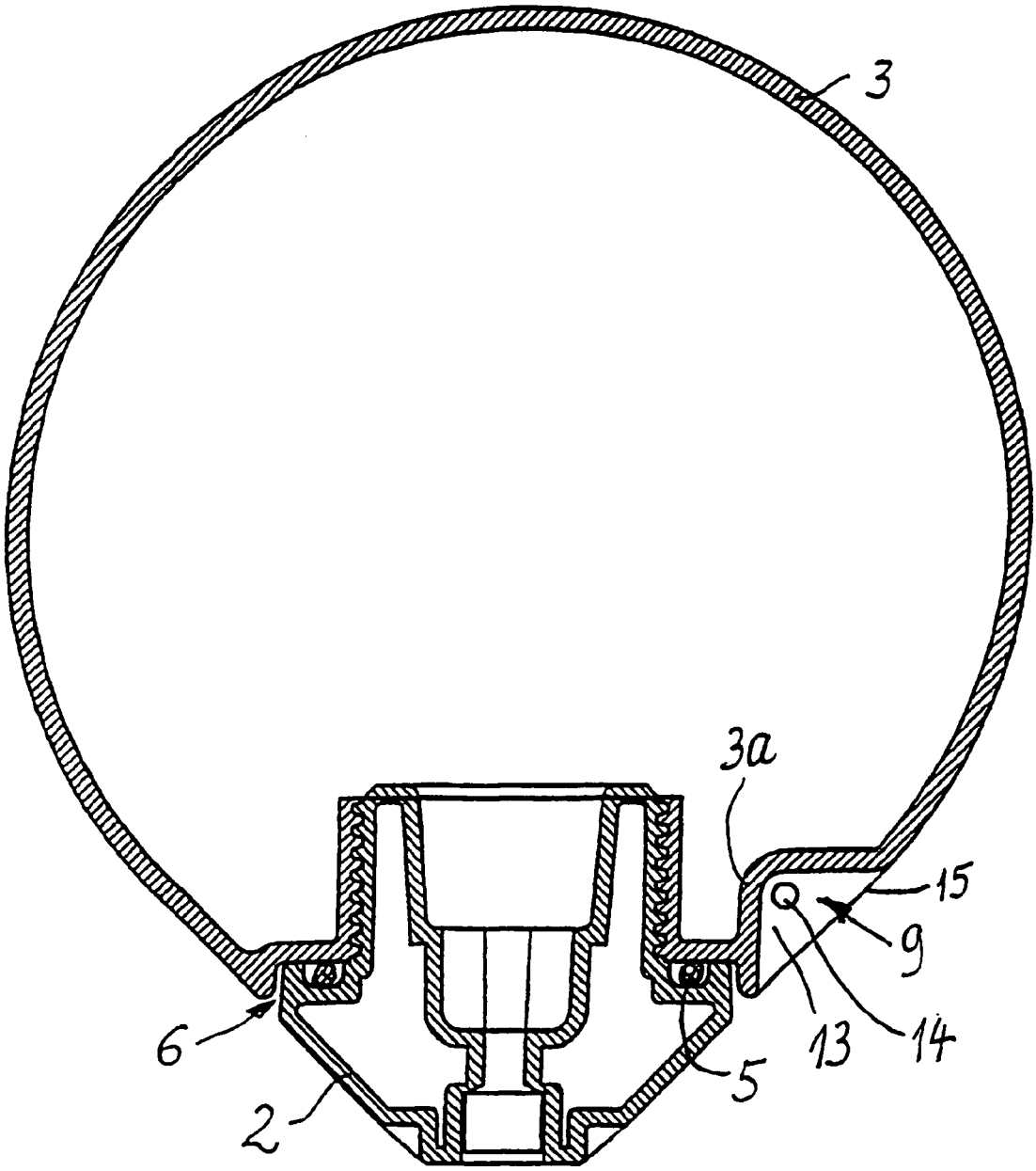
FIG. 4 shows a perpendicular cross-section through the floating light which is assembled from a light base and light screen, the light source being omitted for clarity.
Figure 5:
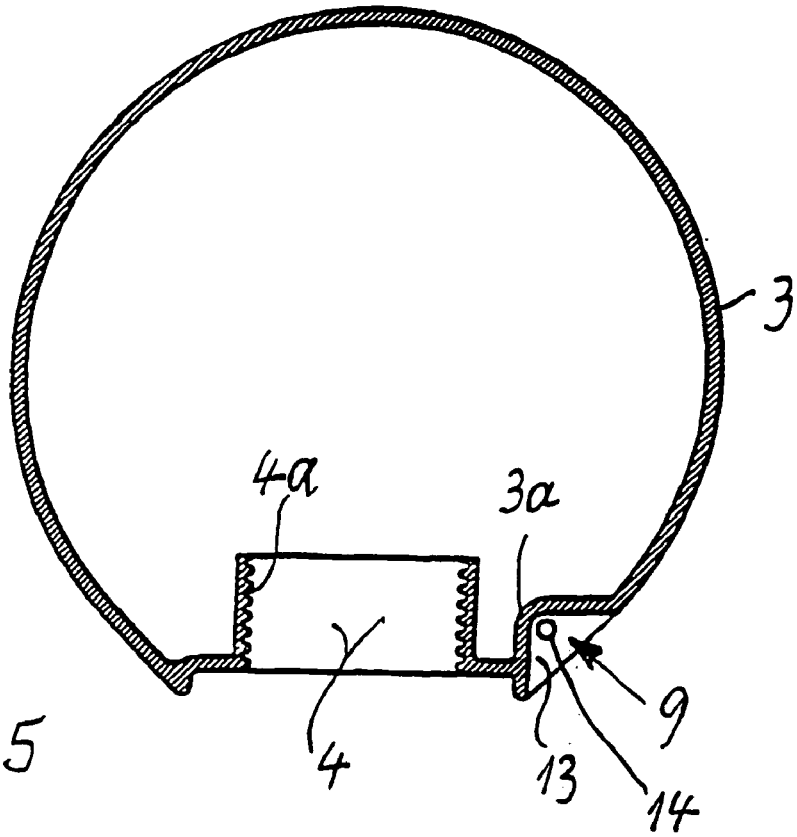
FIG. 5 shows a cross-section corresponding to FIG. 4 through the light screen without a light base.

Accordingly, the light screen 3 has an aperture 4 with an internal thread 4*a* (see FIG. 5) for connecting with a light base 2 having a matching external thread, which will become clear on observing FIGS. 4 and 5 together. For the rest, the light screen 3 is closed and has a substantially spherical surface. In the contact area 6 between the light screen 3 and light base 2, a seal is provided by a sealing ring 5, which is here provided as an O-ring but which likewise could be designed as in EP 0 907 865 B1. In any case, a sealing element or sealing ring 5 is pressed on the respective sealing surfaces by the threaded connection between the light base 2 and light screen 3, so that this sealed contact area between the light base 2 and light screen 3 can be arranged in the use position beneath the surface 7 of the liquid receiving the floating light 1 and thus be practically invisible in use.

Figures 1, 2, 3:
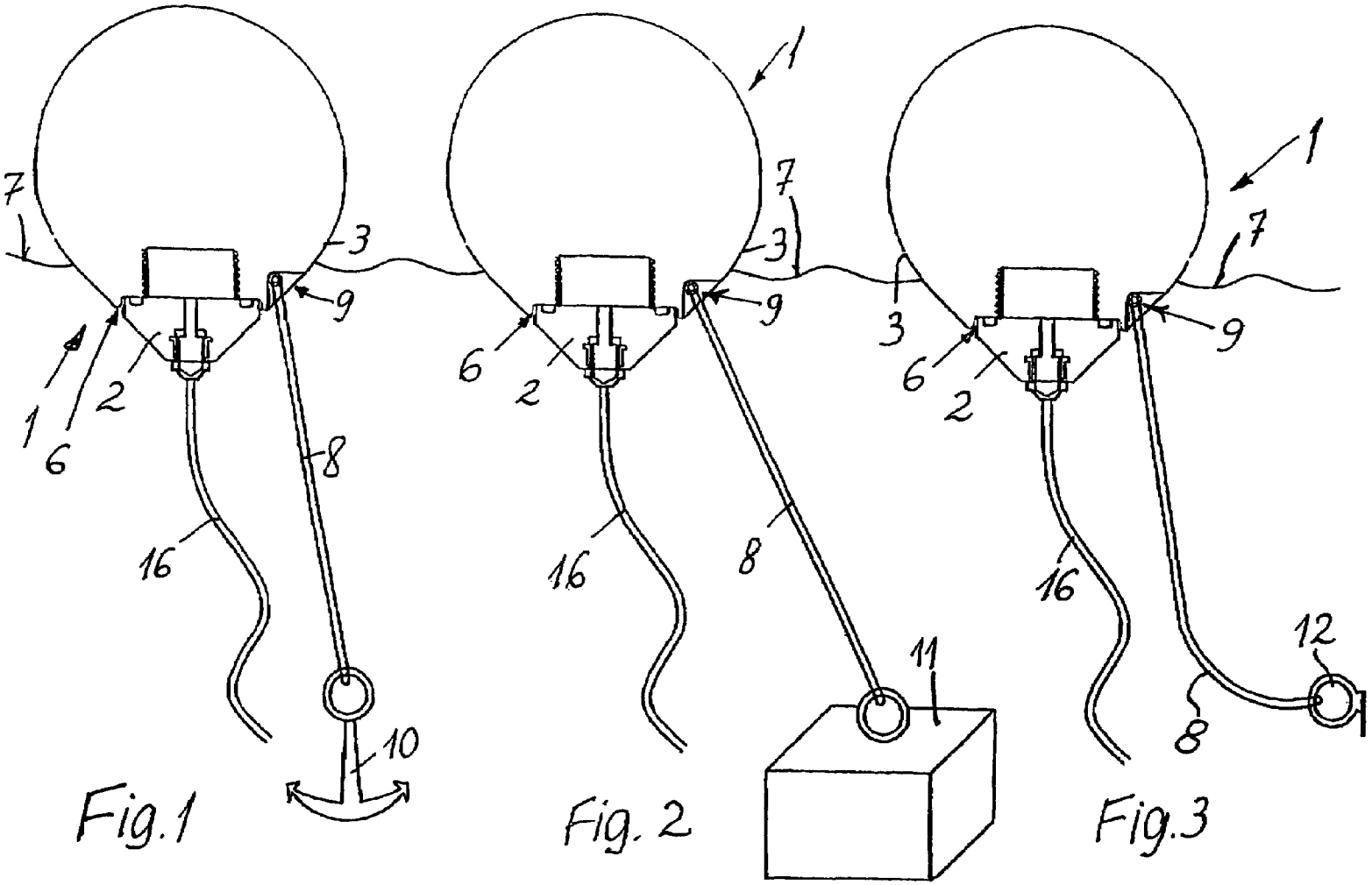
FIG. 1 shows a view of the floating light in the use position, anchored with a fastening element anchored under the water surface and, located on this element, an anchor at the bottom of the stretch of water on which the floating light floats.
FIG. 2 shows a view corresponding to FIG. 1, in which a weight at the bottom of the stretch of water is provided instead of an anchor on the fastening element.
FIG. 3 shows a view corresponding to FIGS. 1 and 2, in which the fastening element retaining the floating light is suspended under the water surface, on an eyelet at its end remote from the floating light.

It is shown in FIGS. 1–3 that on the light screen 3 in the use position at least one fastening element 8 is arranged that extends under the surface 7 of the liquid and is anchored or anchorable there. The retaining force of this fastening element 8 on the floating light 1 can thus be transmitted to the light screen 3 and not to the light base 2, so that even with a greater force relative to this, the sealed area cannot be loaded in the direction of a loosening of the seal, but with increasing loading the pressure on the sealing ring or sealing element 5 can be increased even in the direction of improving the sealing action when, for example, the floating light 1 is drawn with increased force a little deeper into the liquid in order to position it at a given place especially securely and firmly.

Figure 6:
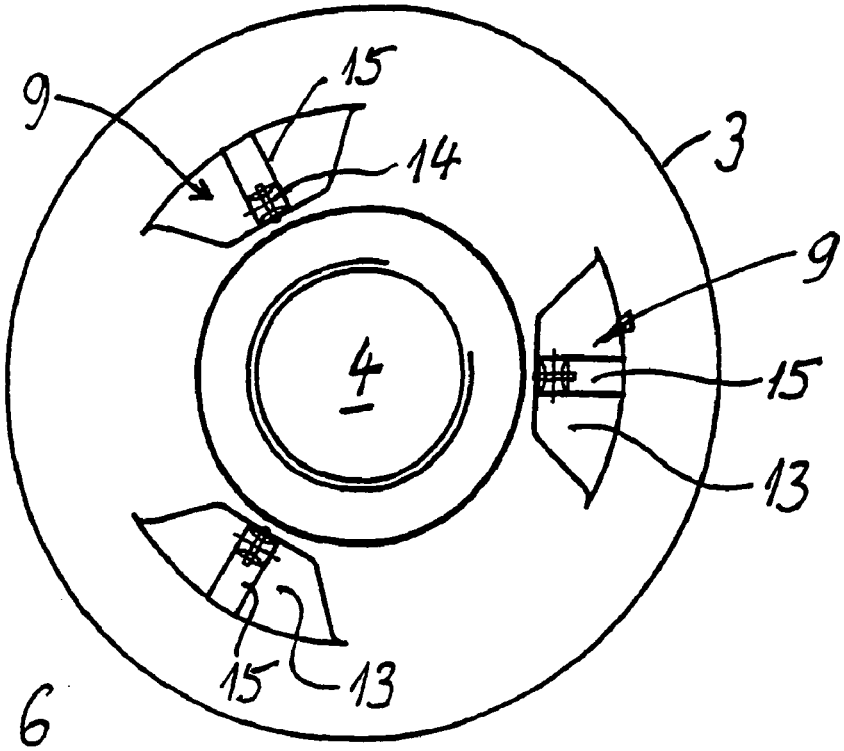
FIG. 6 shows a view of the underside of the light screen with a view of the fastening places for one or more fastening elements for anchoring the floating light in a stretch of water.

The light screen 3, according to FIGS. 1–5, has at least one fastening place 9, and according to FIG. 6 even three fastening places 9 for one or more fastening elements 8, which are embodied as tension elements in the exemplary embodiment. These fastening places 9 are at the same height and uniformly distributed around the periphery. Thus a fastening element 8, particularly in the form of a tension element, could engage each fastening place 9 or, according to FIGS. 1–3, only one selected fastening place 9.

At the end of the fastening element(s) 8 located under water remote from the floating light 1, there can be arranged according to FIG. 1 an anchor 10, according to FIG. 2 a weight 11, and according to FIG. 3 an eyelet 12 arranged on a boundary, with which the fastening element or tension element 8 can thus be fixed under water. It can then be relatively tightly tensioned or loosely suspended, in order to still give the floating light 1 a certain freedom of movement on the water surface 7, so that it can be changed in its position in a predetermined limited region by wind or current.

The weight 11 engaging the fastening element(s) 8 under water appropriately has a weight or such a size to exceed the buoyancy of the floating light 1 in the liquid. Thus the position of the weight 11, and hence also the position of the floating light 1, may be changed; however, the buoyancy of the floating light cannot carry the weight and displace it in an undesired manner within a stretch of water, for example due to wind influence. In comparison with the anchoring according to FIG. 3, the user nevertheless has the possibility of installing the floating light at a completely optional place within a stretch of water.

The possibility exists that the length of the fastening element 8 is preselectable and/or adjustable, in order to effect adaptation to stretches of water of different depths and/or to give more or less play for the floating light 1 to move back and forth on the water surface 7.

The fastening places 9 for the fastening element 8 retaining the light screen 3 and therewith the floating light 1 are arranged in the region of the light screen 3 of about spherical shape which in the use position according to FIGS. 1–3 is situated beneath the greatest horizontal diameter, and in particular under water. In practice, the fastening places 9 are directly adjacent to the contact area 6 for the light base 2.

According to FIGS. 4–6, the fastening places 9 are formed on the surface of the light screen 3 as a recess or notch 13 separated from the interior of the light screen 3 by a wall 3*a*, with an eyelet 14 arranged there on a projection 15. The fastening place 9 is thus integrally formed on the light screen 3. The fastening place itself, namely the eyelet 14 in the embodiment example, is arranged on the surface of the light screen 3 in the hollow 13 of this surface and is completely sunk within this hollow or recess 13. Thus due to the fixing of the fastening element 8 on the light screen 3 practically no projection results on its surface, although such a projecting fastening place 9 would be possible, particularly below the water surface 7.

As shown in FIGS. 4 and 5, the spherical surface of the light screen 3 merges below its greatest horizontal diameter into a frustroconical surface, tapering downward in the use position and with the entry opening 4 for the sealed light base 2, and thus the contact area 6, arranged at its lower edge. The fastening places 9 for anchoring the floating light 1 are arranged in this region of the light screen 3 having the frustroconical surface. This improves the transmission of forces to be introduced and confers on the floating light 1 in the floating process a better stability of its position within the liquid, even when the fastening element 8 is loose and the floating light can float relatively freely.

In the embodiment, the portion of the light base 2 projecting outward, and in the use position downward, with respect to the aperture 4 in the light screen 3 has a frustroconical or conical surface and this substantially continues the frustroconical region of the light screen 3 and thus augments the light screen at its lower side to a longer conical frustrum or cone. Thus the floating light 1 has a lower, conically tapering region which stabilizes its floating position in a predominantly upright position, to which the weight of the light base 2 with the light source or lighting means also contributes.

The fastening element 8 provided as a tension element can be a rope, a cord, a cable, or a chain, else a bar or a rod. In addition the electrical cable 16 can be seen in FIGS. 1–3, supplying the lighting means with current and itself not employed for anchoring. Because of the fastening element 8, the application of a tension force to this electrical cable 16 due to any movements or loads on the floating light 1 can on the contrary be avoided.

The floating light 1, with a light base 2 receiving a light source or lighting means, and surrounding it and connected thereto a light screen 3, which has an entry aperture 4 for connecting to the light base 2 and furthermore a closed, in particular substantially spherical surface, has a seal in the contact region in the contact area 6 between the light screen 3 and light base 2, in particular a sealing element or a sealing ring 5, so that this sealed contact area 6 can be situated beneath the surface 7 of a liquid in which the floating light 1 is to float. In order to be able to establish the floating light 1 stationary in such a liquid, or with only a little freedom of movement, a fastening element is arranged on the light screen 3, running in the use position under the surface 7 of the liquid and anchored or anchorable there, so that forces acting on this fastening element 8 do not load the contact area 6, as would be the case with a fastening to the light base 2.

The invention claimed is:

1. Floating light (1) comprising:

a light base (2) that receives at least one light source;

a light screen (3) connected to the light base (2) and surrounding the light source, having an aperture (4) for connection with the light base (2), and a closed, substantially spherical surface;

a seal or a sealing element (5) between the light base (2) and light screen (3) which forms a sealed contact area (6), the sealed contact area (6) between the light screen and the light base adapted for being located below a surface (7) of a liquid which receives the floating light (1) in a use position;

at least one fastening element (8) attached to the light screen (3), adapted to extend in the use position under the surface (7) of the liquid and adapted to be anchored or anchorable; and a plurality of fastening places (9), for connection to the at least one element or tension elements, arranged on a periphery of the light screen in a region which in the use position is situated beneath a greatest horizontal diameter of the light screen, wherein the at least one fastening element (8) connects to at least one of the fastening places (9) in the use position.

2. Floating light according to claim 1, wherein the at least one fastening element (8) is a tension element, and at least one of an anchor (10), a weight (11), a hook, and an eyelet (12) is connected to an end of the at least one fastening element (8) opposite the light screen (3).

3. Floating light according to claim 1, wherein the at least one fastening element (8) comprises at least one of a rope, cord, cable or chain, a bar and a rod.

4. Floating light according to claim 1, wherein a length of the at least one fastening element (8) is at least one of preselectable and adjustable.

5. Floating light (1) comprising:

a light base (2) that receives at least one light source;

a light screen (3) connected to the light base (2) and surrounding the light source, having an aperture (4) for connection with the light base (2), and a closed, substantially spherical surface;

a seal or a sealing element (5) between the light base (2) and light screen (3) which forms a sealed contact area (6), the sealed contact area (6) between the light screen and the light base adapted for being located below a surface (7) of a liquid which receives the floating light (1) in a use position;

at least one fastening element (8) attached to the light screen (3), adapted to extend in the use position under the surface (7) of the liquid and adapted to be anchored or anchorable; and a plurality of fastening places (9) arranged on a periphery of the light screen at least one of the fastening places is formed on a surface of the light screen (3) as at least one of a recess, notch, eyelet (14), projection (15) or hook, separated from an interior of the light screen (3) by a wall (3*a*), wherein the at least one fastening element (8) connects to at least one of the fastening places (9) in the use position.

6. Floating light according to claim 5, wherein at least one of the fastening places is arranged on the surface of the light screen (3) in a hollow (13) formed in the surface.

7. Floating light according to claim 5, wherein the at least one fastening element (8) comprises at least one of a rope, cord, cable or chain, a bar and a rod.

8. Floating light according to claim 5, wherein a length of the at least one fastening element (8) is at least one of preselectable and adjustable.

9. Floating light (1) comprising:

a light base (2) that receives at least one light source;

a light screen (3) connected to the light base (2) and surrounding the light source, having an aperture (4) for connection with the light base (2), and a closed, substantially spherical surface;

a seal or a sealing element (5) between the light base (2) and light screen (3) which forms a sealed contact area (6), the sealed contact area (6) between the light screen and the light base adapted for being located below a surface (7) of a liquid which receives the floating light (1) in a use position; and at least one fastening element (8) attached to the light screen (3), adapted to extend in the use position under the surface (7) of the liquid and adapted to be anchored or anchorable;

wherein the substantially spherical surface of the light screen (3) merges below a greatest horizontal diameter region thereof into a frustroconical surface that tapers downward in the use position, and wherein the aperture (4) for the sealed light base (2) is arranged on a lower edge of the frustroconical surface.

10. Floating light according to claim 9, wherein a plurality of fastening places (9) for fastening or tension elements are arranged on a periphery of the light screen, and wherein the at least one fastening element (8) engages in the use position on at least one of the fastening places (9).

11. Floating light according to claim 10, wherein a weight (11) engages the at least one fastening element (8), with the weight having a weight that is greater than a buoyancy of the floating light (1) in the liquid.

12. Floating light according to claim 9, wherein at least one of the fastening places for anchoring the floating light (1) is arranged in a region of the light screen (3) which has the frustroconical surface.

13. Floating light according to claim 9, wherein a portion of the light base (2) projects outward and, in the use position, downward with respect to the aperture (4) in the light screen (3), and wherein the light base (2) includes at least one of a frustroconical and conical surface, which substantially continues the frustroconical surface of the light screen (3) or augments it to a longer conical frustrum or cone.

14. Floating light according to claim 9, wherein the at least one fastening element (8) comprises at least one of a rope, cord, cable or chain, a bar and a rod.

15. Floating light according to claim 9, wherein a length of the at least one fastening element (8) is at least one of preselectable and adjustable.

* * * * *